US008646534B2

(12) United States Patent
Magden

(10) Patent No.: US 8,646,534 B2
(45) Date of Patent: Feb. 11, 2014

(54) WELL HEAD CONTAINMENT FITTING DEVICE

(76) Inventor: Richard R. Magden, Union Grove, WI (US)

( * ) Notice: Subject to any disclaimer, the term of this patent is extended or adjusted under 35 U.S.C. 154(b) by 0 days.

(21) Appl. No.: 13/474,830

(22) Filed: May 18, 2012

(65) Prior Publication Data

US 2012/0298374 A1 Nov. 29, 2012

Related U.S. Application Data

(60) Provisional application No. 61/489,113, filed on May 23, 2011.

(51) Int. Cl.
*E21B 33/038* (2006.01)
*E21B 33/076* (2006.01)
*E21B 43/013* (2006.01)

(52) U.S. Cl.
USPC ..... 166/343; 166/338; 166/345; 166/360; 166/363; 166/378

(58) Field of Classification Search
USPC ..... 166/338, 341, 343–345, 351, 360, 363, 166/364, 368, 378–380, 85.1, 85.5, 96.1, 166/75.13; 285/18, 405, 412, 368; 411/999, 411/375.5
See application file for complete search history.

(56) References Cited

U.S. PATENT DOCUMENTS

| | | | | | |
|---|---|---|---|---|---|
| 1,493,197 | A | * | 5/1924 | Hall | 411/340 |
| 1,981,279 | A | * | 11/1934 | Mueller | 166/86.3 |
| 2,124,840 | A | * | 7/1938 | Wrigley | 166/84.1 |
| 2,157,964 | A | * | 5/1939 | Mueller | 166/88.2 |
| 2,313,169 | A | * | 3/1943 | Penick et al. | 285/123.6 |
| 2,389,344 | A | * | 11/1945 | Alvin | 411/555 |
| 3,180,390 | A | * | 4/1965 | Ockert, Jr. | 411/348 |
| 3,848,421 | A | * | 11/1974 | O'Brien et al. | 405/170 |
| 4,472,085 | A | * | 9/1984 | Mohler | 405/255 |
| 4,589,179 | A | * | 5/1986 | Hulting, Jr. | 29/256 |
| 4,609,209 | A | * | 9/1986 | Ralls | 285/24 |
| 4,883,398 | A | * | 11/1989 | Duncan | 411/344 |
| 4,971,502 | A | * | 11/1990 | Oh | 411/340 |
| 5,103,900 | A | * | 4/1992 | McLeod et al. | 166/88.1 |
| 5,273,117 | A | * | 12/1993 | Reimert | 166/348 |
| 5,289,882 | A | * | 3/1994 | Moore | 166/379 |
| 6,419,279 | B1 | * | 7/2002 | Latham | 285/261 |
| 7,182,574 | B2 | * | 2/2007 | Lyons | 415/213.1 |
| 7,296,631 | B2 | * | 11/2007 | McGuire et al. | 166/379 |
| 7,614,448 | B2 | * | 11/2009 | Swagerty et al. | 166/177.5 |
| 7,650,936 | B2 | * | 1/2010 | McGuire et al. | 166/75.13 |
| 7,726,393 | B2 | * | 6/2010 | Duhn et al. | 166/75.13 |
| 7,802,825 | B2 | * | 9/2010 | Jensen | 285/419 |
| 8,272,433 | B2 | * | 9/2012 | Duhn et al. | 166/75.13 |
| 2008/0100060 | A1 | * | 5/2008 | Hayashi et al. | 285/148.8 |

* cited by examiner

*Primary Examiner* — Matthew Buck
*Assistant Examiner* — Edwin Toledo-Duran
(74) *Attorney, Agent, or Firm* — Economou IP Law; Vangelis Economou

(57) ABSTRACT

A containment fitting for a wellhead capping device including a truncated conical section capable of fitting into a central aperture of a flange that is attached to a ruptured wellhead pipe end and which can be fitted into position by several wires or cables that are pulled through apertures in the pipe wellhead flange. A method of installation includes undersea welding of the flange onto the end of the ruptured wellhead and inserting plural bobbin structures attached to cable wires into through holes extending at angularly opposed sides of the flange such and when completely in line through a second flange on constriction equipment, can bring the flanges adjacent and in line to permit attachment therebetween by bolts.

10 Claims, 7 Drawing Sheets

WELL HEAD CONTAINMENT FITTING DEVICE

CROSS REFERENCE TO RELATED APPLICATIONS

This is a non-provisional of Provisional Patent Application No. 61/489,113 filed on May 23, 2011, which application is incorporated by reference as if fully set forth herein.

BACKGROUND OF THE INVENTION

1. Field of the Invention

The present invention relates generally to a well head containment fitting device for attachment to a production wellhead that has ruptured or otherwise presents an uncontrolled leak, and more particularly, to such a device as used to cap a deep water petroleum well that has become uncontrollable from failure of its safety systems.

2. Background Art

A typical production wellhead in an underwater setting includes a rod string extending from the water surface to a wellbore beneath the surface containing a fluid, such as hydrocarbons, and a driving or pumping unit connected to the rod string for producing the fluid from the wellbore. When the underwater oil well is under water, especially in very deep water, that is, over 3000 feet (1000 meters), and in certain other instances, the hydrocarbon, either in gas or liquid form, is under a great deal of pressure even exceeding 2000 psi (13,780 dyne/sq.m.).

Many of the known containment devices are designed to simply collect the escaping fluid within a container or chamber as the escaping fluid remains in a freely flowing form, that is, the devices contain the flowing liquid being ejected at great pressure in a containment vessel, and evacuate it as it is collected. Although the fluid may be collected in the container, the fluid is not intended to be retained within that container, but must be evacuated to permit the further collection of continuing flow of liquid. Each of the prior art devices includes a drain, drain valve or drain tubing such that the liquid can be withdrawn from the containment vessel. Prior art devices provide for the flow of the fluid out of the device through the drain. The drained fluid is then collected for disposal in a second storage container, typically located apart from the device, and usually on the surface of the water under which the wellhead rests.

Since the leaking fluid necessarily flows freely within these devices, a tight seal between the device and the stuffing box must be maintained during operation of the device in order to prevent leakage and spills from the device into the environment, whether undersea or floating to the surface. Precautions are also required to prevent leakage or spills from either the drain structure or the secondary storage containers into the environment.

To further explain the known methods of spillage containment, the process of the undersea wellhead will be discussed. Typically, the wellhead is drilled after a number of safety devices are in place, so that when the petroleum or other fluid that is being produced by the wellhead begins to flow under great pressure to the surface for collection, sufficient mechanisms and ample redundancy in the system are in place to shut down the wellhead at or near the source in the event that any problems develop.

For example, fluid produced from the wellhead sometimes includes a significant portion of heavy oil, or includes sand, clay or other particulate matter, which causes stress to develop in the equipment due to sluggish flow of the dense or particle containing liquid. In such a case, the pipes and other devices that are used to evacuate the fluids from the wellhead may become clogged or blocked, thus preventing proper drainage from the device. In very deep waters, the extreme pressures and large distances from the warming rays of the sun, otherwise available in waters closer to the surface, cause the water to be reduced to very low temperatures, even below the normal freezing point of water (at the surface). When these devices are used in colder climates, escaped fluid may freeze within critical junctions of the device or within the drainage means, such as pipes, preventing proper flow of fluid therethrough. If the drainage means is incapable of functioning properly, the fluid can collect within the device until the containment vessel is so full as to render it inoperative to further collect fluid. In that case, the fluid finds a weak spot in the device and begins to leak into the environment.

Other problems can develop when there is a significant amount of natural gas entrained in petroleum being produced. When such a fluid mixture reaches the surface, the natural gas goes out of solution and creates pockets within the piping and equipment, and under extreme circumstances may lead to explosive and sometime catastrophic conditions. Such an event occurred at an undersea wellhead in the Gulf of Mexico in 2010, leading to a major environmental disaster.

Leaking fluid is not desirable because not only is there a loss of production because the fluid is no longer being collected, but most importantly, severe damage to the environment occurs if the fluid is permitted to leak externally in large amounts. Thus, the wellhead systems must continue to operate normally, or the system must have a mechanism to ensure shut down of the fluids being pumped out of the wellhead. Thus, to ensure shut down and to reduce delay in the shut down, a large number of redundant systems are necessary to ensure that the flow of fluid ceases when needed. On occasion, and as has been widely reported in press reports, the wellhead may develop these and other problems that, if left unchecked, cause the wellhead to completely malfunction, requiring the wellhead to be shut down and production to cease.

A major environmental disaster can occur when the wellhead loses all the redundancy and cannot be shut down when a fluid leak develops. For example, once a rupture in the pipe system that is draining the wellhead production is complete, the safety systems are brought to effect to shut down the flow completely, thereby to permit repairs to be made. If one or more of the safety systems are inoperative for whatever reason, then the redundant systems are brought into operation to complete repairs so that the functional systems are all operating normally. If all the redundancy fails, then the a serious problem develops and the wellhead becomes a runaway leak spewing fluid directly from the wellhead opening and any broken piping that is in place, causing a spill that requires remediation action, such as collecting as much as possible of the spilled fluid at the surface. This is not always feasible in deep open water, especially in unfavorable weather conditions. Because of the serious environmental damage results from a runaway well, it becomes imperative to cap the well and stanch the fluid flow so that the well can be repaired or permanently capped.

A need exists in the industry for a device for shutting of the fluid flow and collecting and retaining the fluid which tends to escape from the wellhead between the top of the stuffing box and the rod string in the event of failure of all the redundant safety systems. The procedure must be able to operate in the high pressure and cold water environment of deep water drilling. Further, there is a need for the device to remove the fluid from the well as it is being shut down, and to remove the fluid in an efficient and efficacious manner, as compared to prior art devices, so as to inhibit leakage and which minimizes the risk of leaks or spills to the environment.

SUMMARY OF THE INVENTION

1. Accordingly, there is disclosed and claimed herein a wellhead containment fitting device and method of installing same, comprising in broad scope, the wellhead containment fitting device for capping a runaway deep undersea hydrocarbon well head having a longitudinally directed cylindrical portion having at least one peripheral wall defining an inner and an outer diameter, and top and bottom ends, a truncated conical portion disposed adjacent the bottom end of the longitudinally directed cylindrical portion, the truncated conical portion having a convergent outer surface extending from an intersection of the peripheral wall and the convergent outer surface, and converging toward a central aperture having an inner diameter at least one-half of the inner diameter of the longitudinally directed cylindrical portion and a flange extending outwardly from the intersection of the peripheral wall and the convergent outer surface and extending essentially perpendicularly from the outer surface of the at least one peripheral wall and being disposed completely around the peripheral wall. The method of installation in an undersea environment comprises locating a pipe flange disposed on and sealingly connected to an end of the wellhead pipe, the flange having plural throughholes of a predetermined diameter extending through a width of the pipe flange and around a circumference of the pipe flange, providing a containment fitting having a longitudinally directed cylindrical portion and a truncated conical portion defining a central aperture at the truncated part, and a fitting flange extending outwardly essentially perpendicularly from the surface of the longitudinally directed cylindrical portion, the fitting flange having plural throughholes of a predetermined diameter extending through a width of the fitting flange and around a circumference of the flange, the fitting flange throughholes corresponding in size, orientation and number to the plural throughholes of the pipe flange, providing plural flange engagement members each comprising an enlarged head at one end having a diameter larger than the predetermined diameter and a wire extending in a direction away from the head, the wires each having a bobbin at an end removed from the enlarged head, threading the bobbin of each engagement member through selected ones of the plural throughholes of the fitting flange so as to engage an upper surface of the fitting flange, threading the bobbin of each engagement member through selected ones of the plural throughholes of the pipe corresponding to the selected throughholes of the fitting flange, pulling the wires and bobbins in a direction perpendicularly outward from the flanges to pull the enlarged heads of the flange engagement members and the fitting flange toward the pipe flange and inserting bolts through both the fitting flange and pipe flange throughholes and engaging the bolts and nuts to retain the flanges in an engaged condition.

BRIEF DESCRIPTION OF THE DRAWINGS

The present invention will now be discussed in further detail below with reference to the accompanying figures in which.

DETAILED DESCRIPTION OF THE PREFERRED EMBODIMENTS

Figure 1:
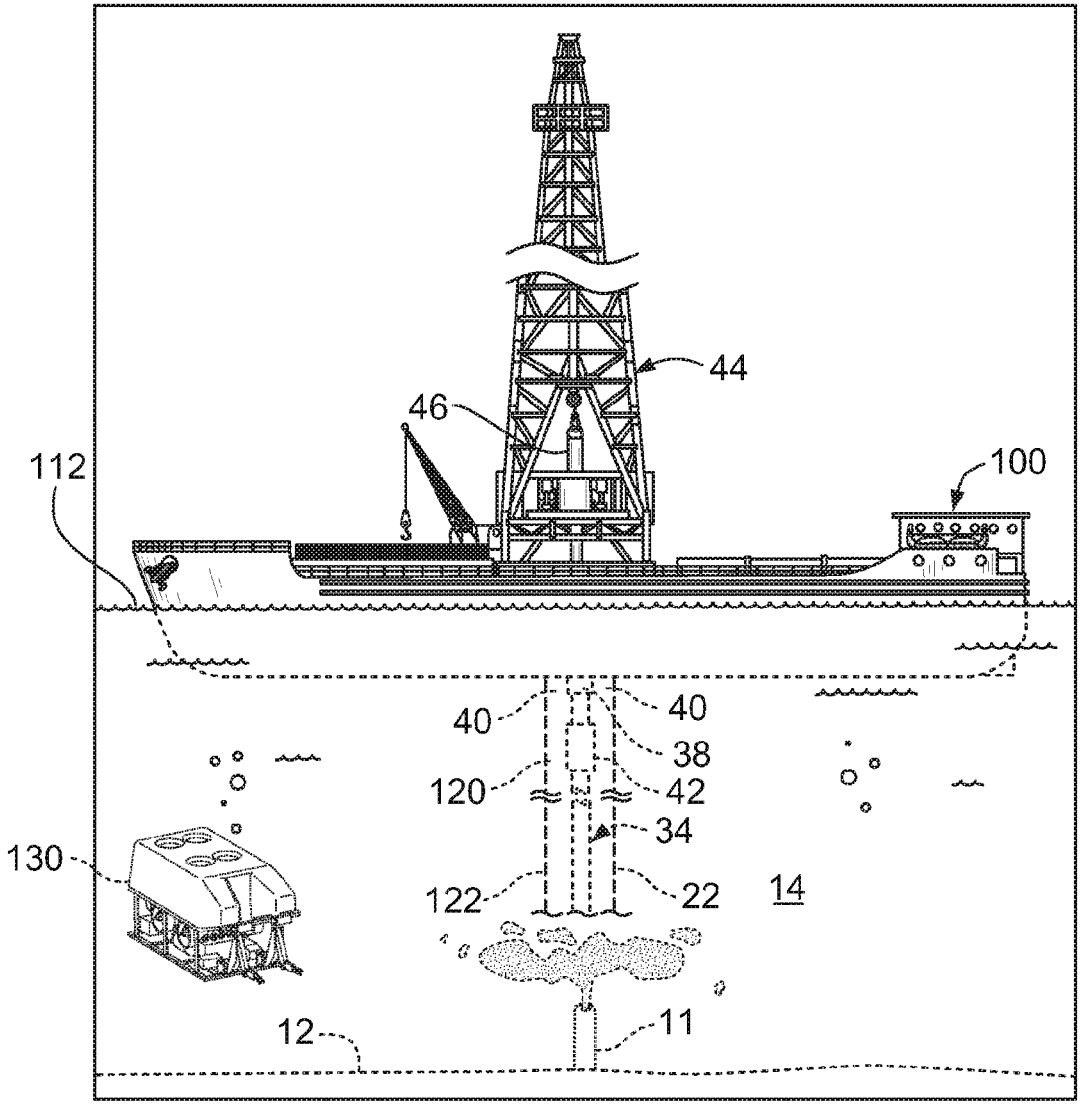
FIG. 1 illustrates in a stylized view a drilling rig that includes the elements necessary for the repair and fluid containment of a ruptured deep undersea wellhead.

Referring now to FIG. 1, a schematic diagram of a deep undersea fluid well having a ruptured pipe stack 11 is shown in phantom, with a landing vessel 100, similar to a drill rig operation for oil drilling in open waters, such as is described in U.S. Pat. No. 6,966,392 floating above the pipe stack 11. While a drilling rig may be stationary or fixed relative to the seabed 12, the landing vessel 100 will necessarily be floating above the ruptured pipe stack 11 since it will have been called only in the event of a catastrophic failure of the pipe 11. It will be readily understood that FIG. 1 is not to scale, as the water environment 14 is very deep for these types of rigs, and may extend undersea for more than a mile to reach the pipe stack 11. However, certain modifications may be necessary to known drill rigs so as to enable them to provide the added functions of the inventive device that will be discussed with regard to the features of the invention.

In FIG. 1, the pipe stack 11 is shown in a completely ruptured state and terminating at an end that is jagged or otherwise not machined, which would represent a catastrophic event. It may be possible that that the pipe stack 11 may have been disconnected at a point above a joint in which a flange is still intact, such as that described in U.S. Pat. No. 3,215,166, the teachings of which are incorporated herein by reference, in which case the first steps in the containment process can be omitted. However, for purposes of description of this invention, catastrophic damage to the wellhead will be assumed, and the invention will be described in reference to such condition.

Again referring to FIG. 1, the landing vessel 100 comprises a modified drilling rig ship, as shown, floating on the surface 112 of the undersea water 14 and above the ruptured pipe stack 11. Landing vessel 100 serves as the base of operations for the pipe stack repair and as a possible collecting and transfer point for the hydrocarbons emanating from the well once the repairs have been completed and production resumes. In FIG. 1, there is illustrated in phantom a floating upper end of a conductor pipe stack 120 extending below the landing vessel 100 which can be used to introduce and operate the equipment that comprise the features of this invention. Guidelines 122 are preferably secured in a guide structure 22 for permitting the operators in vessel 100 to lower a pipe stack 40 having appropriate joints 42 and other equipment to the sea floor 12. Alternatively, a flexible riser pipe installation, such as is taught in U.S. Published Patent Application No. 2010/018717, may be used to connect to the wellhead once the ruptured pipe has been repaired.

Another, and preferred, alternative is to provide a submersible remotely operated vehicle 130, as shown in schematic in FIG. 1 and in greater detail in FIG. 1A, for submersion to the immediate vicinity of the ruptured pipe 11, and to perform operations thereon as discussed below. Submersible remotely operated vehicles 130, such as the robotic craft shown, are automatically and remotely controlled from the surface by electronics or by wires and are capable of a variety of operations at submerged deep sea locations. Examples of such submersible craft abound, including the ones shown and described in U.S. Pat. No. 6,290,431 to Exley, et al., the disclosure of which is hereby incorporated by reference. All these alternative methods for providing working platforms in deep sea environments are known and used in the undersea oil production industry.

The fluid to be contained within the wellbore and spewing from the end of the ruptured pipe 11, would have been normally produced by the wellhead connected to an oil rig or derrick (not shown), which in a catastrophic incident, may have been completely borne off, for example, by a catastrophic hurricane, and thus not in the picture. The fluid that may be produced by the oil rig may have be any fluid having any composition capable of being produced by the wellhead and is typically comprised of hydrocarbons. However, the fluid is rarely homogeneous and may include a combination of hydrocarbons, both liquid and gaseous under normal pressures, such as oil or natural gas, but other liquids, such as water, and even solids, such as sand, clay or mineral particles, may be entrained therein. The fluid may include an amount of solid particulate matter, such as. The elements of a production wellhead are known and will not be described herein with any particular reference, other than how the wellhead bore elements are attached once again to the repaired pipe 11 to either shut down the deeps sea well or to resume production therein.

Figure 1A:
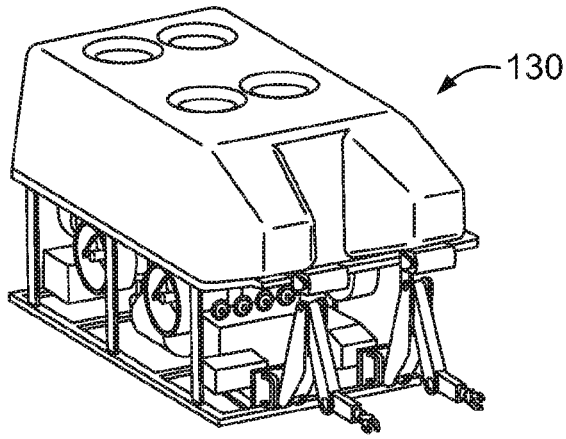
FIG. 1A is a detail of a known representative undersea remote operating vehicle utilizable for working in the deep undersea environment.

Referring now to the submersible remotely operated vehicle shown in FIGS. 1 and 1A, such vehicles are known in the art as being described in aforementioned U.S. Pat. No. 6,290,431, and are designed to perform any of a number of undersea operations including cutting and undersea welding, as will be described below. The details of these operations are not very significant outside the inventive method described and claimed herein, and the description of these functions may be found in many such known vehicles 130, either in literature or by reference to manufacturers' catalogs. Thus, the general functions of these vehicles will be referred to herein, and should additional details of these be desired, reference to the known literature and other prior art descriptions is invited.

Figure 2A:
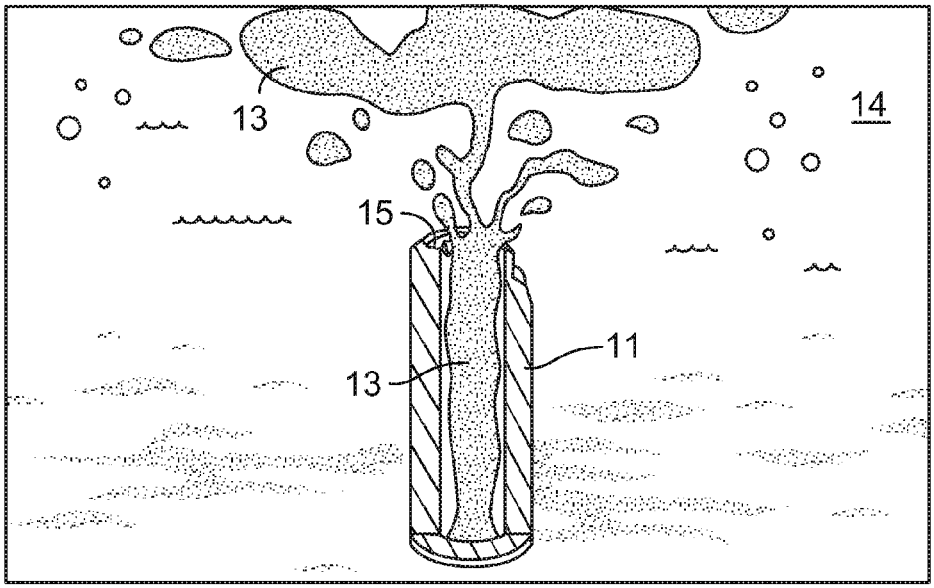
FIG. 2A illustrates in schematic form a ruptured petroleum wellhead from which petroleum under tremendous pressure is spewing forth into the undersea environment.

Referring now to FIG. 2A, a ruptured hydrocarbon well 11 is shown in partial cross-section, with the hydrocarbon fluid 13 flowing freely from the damaged end 15 of the wellhead pipe 11. Such uncontrolled and unrestricted spewing of hydrocarbon fluid 13 in to the undersea environment 14 is normally to be avoided at all times. However, the uncontrolled and indiscriminate flow of hydrocarbons is especially to avoided when the fluid is under extreme pressure, as it usually is in undersea wells, and is spewing out in great volume, thereby causing sever damage to the environment 14. In most respects, all the safety precautions and redundant mechanism are in place and operational for such wellheads, and would normally shut down the fluid flow well before the situation reaches the levels shown in FIG. 2. However, in extreme circumstances, the situation can be as drastic as shown, and then the inventive features of the method and devices described and claimed herein are necessary.

Figure 2B:
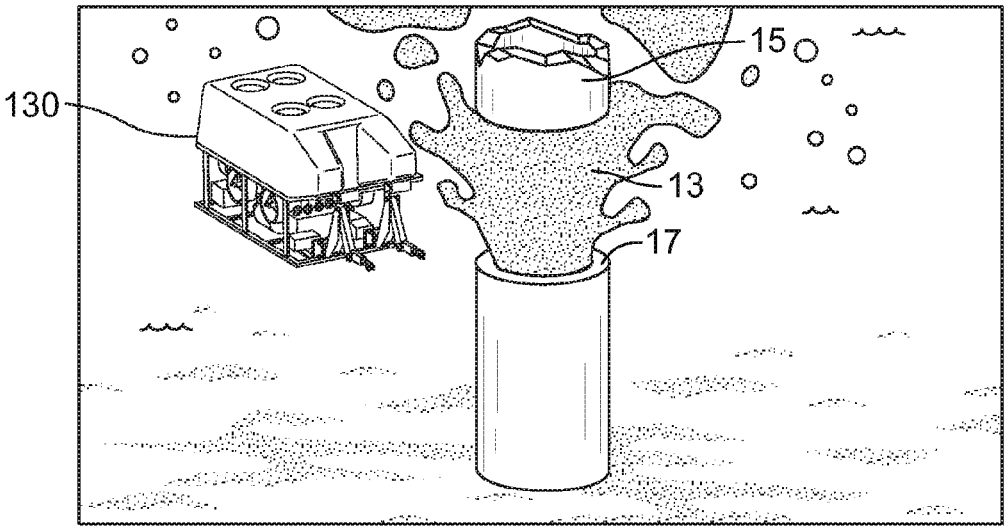
FIG. 2B illustrates in schematic form a ruptured petroleum wellhead after it has been operated on by the undersea remote operating vehicle which has cut away the end of a ruptured pipe and has removed the cut end.

Referring now to FIG. 2, the initial process for repairing a ruptured wellhead 11 is shown. The submersible remotely operated vehicle 130 is shown right after it has completed the cutting operation on the jagged end 15 and has cut around the periphery of the pipe 11 to leave a smooth surfaced end 17 around the periphery of pipe 11 onto which a flange 18 (FIG. 3) can be welded. As shown, once the jagged end 15 is cut away, it can then be removed for disposal. It should be mentioned here that as the cutting operation proceeds, the hydrocarbon fluid 13 continues to spew with great force out of the partly finished end 17 of the pipe 11, and all the operations are done by the remote control from the surface of the sea from the landing vessel 100.

Referring now to FIGS. 3, 4, 5A and 5B, different embodiments of the inventive flanges 50, 60 and 70, each of which are illustrated and will be discussed individually below. One of these flanges 50, 60 and 70 are welded onto the cut away end 17 of the pipe 11 by the remotely controlled vehicle 130. For the greatest part, these flanges are identical and are susceptible of being welded on the end of the pipe 11, as each is preferably designed having a smallest inner diameter aperture 52, 62, 72, respectively, that has a similar or identical inner diameter 19 of the pipe 11.

Figure 3:
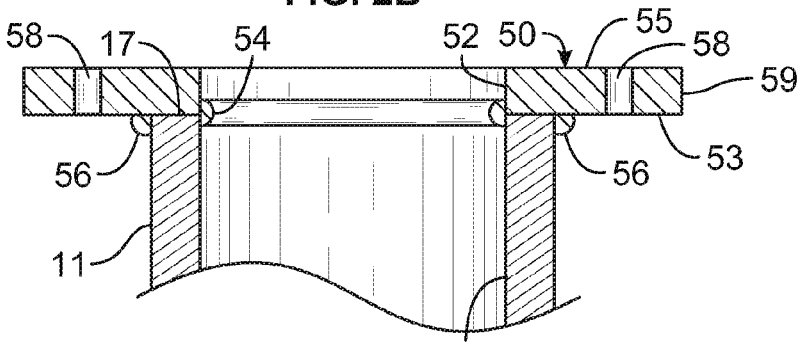
FIG. 3 illustrates the pipe upon which a flange has been welded by the undersea remote operating vehicle.

As is shown in FIG. 3, the flange 50 has an essentially cylindrical inner diameter 52 which essentially matches the diameter 19 and forms a smooth even cylindrical pipe when the remotely controlled vehicle 130 applies a weld 54 on the inner surface to weld the end 17 to the flange 50. A second weld 56 is applied to the outer diameter of the end 17 where it meets the underside 53 of the flange 50, proving a fluid-tight seal between the two elements. Moreover, as the end 17 is cut square to the direction of pipe 11, the outer surface 55 of flange 50 is then perpendicular to the cylindrical surface of pipe 11. As shown in the cross-section of FIG. 3, there are through holes 58 arrayed at predetermined intervals in the flange surface 55 that extend to the surface 53. These through holes 58 are of a diameter that would accommodate bolts (FIG. 6) of a required size, as described below with reference to FIGS. 6 and 7. The outer diameter 59 of the flange 50 has dimension that would accommodate the bolts and would retain integrity of the flange and assembly when a second flange is bolted thereon, even when there is a great amount of pressure and fluid transfer is taking place all around the configuration.

Figure 4:
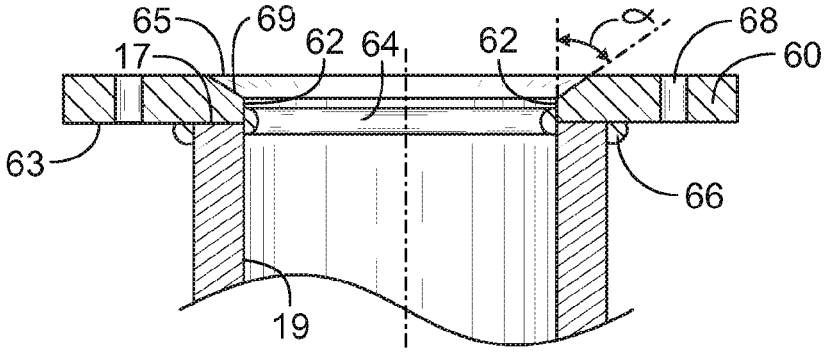
FIG. 4 illustrates the pipe upon which an alternative embodiment of a flange has been welded by the undersea remote operating vehicle.

Referring now to the alternative embodiment of the flange 60 illustrated in FIG. 4, it can be seen that the flange is essentially that same as the flange 50 of FIG. 3, with the exception of an angled countersink is machined into the top surface 65 of flange 60 to face in an upwardly and outwardly direction, which provides a beveled inner diameter edge surface 69, as shown. In most other respects, for example, the inner weld bead 64, the outer weld bead 66 and the throughholes 68 may be identical to the similar elements shown in FIG. 3. As on the flange 50, once the cut end of the pipe 11 is ready and the flange is centered over the pipe so that the respective inner diameters 19 and 62 are aligned, the bead 66 is preferably welded on the outer edge of pipe end 17 first to establish a unitary structure, and then the inner bead 64 is welded by the remotely controlled undersea vehicle 130 to complete a fluid seal between the end 17 of pipe 11 and the flange 60.

Figure 5A:
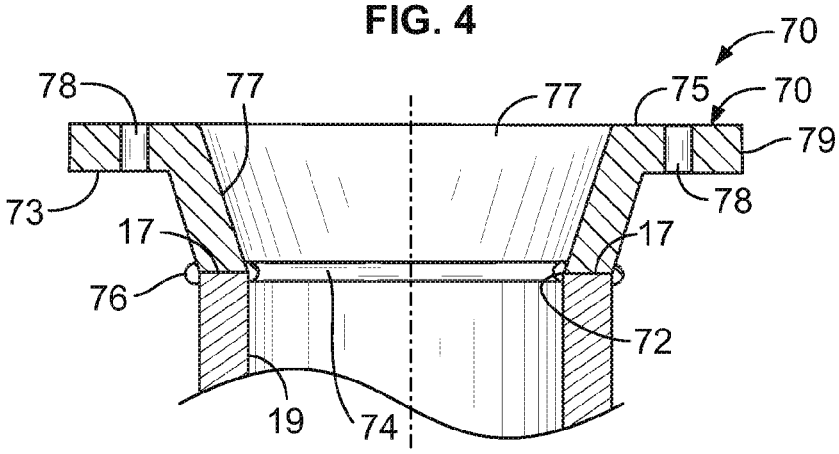
FIG. 5A illustrates the pipe upon which yet another alternative embodiment of a flange has been welded by the undersea remote operating vehicle.
Figure 5B:
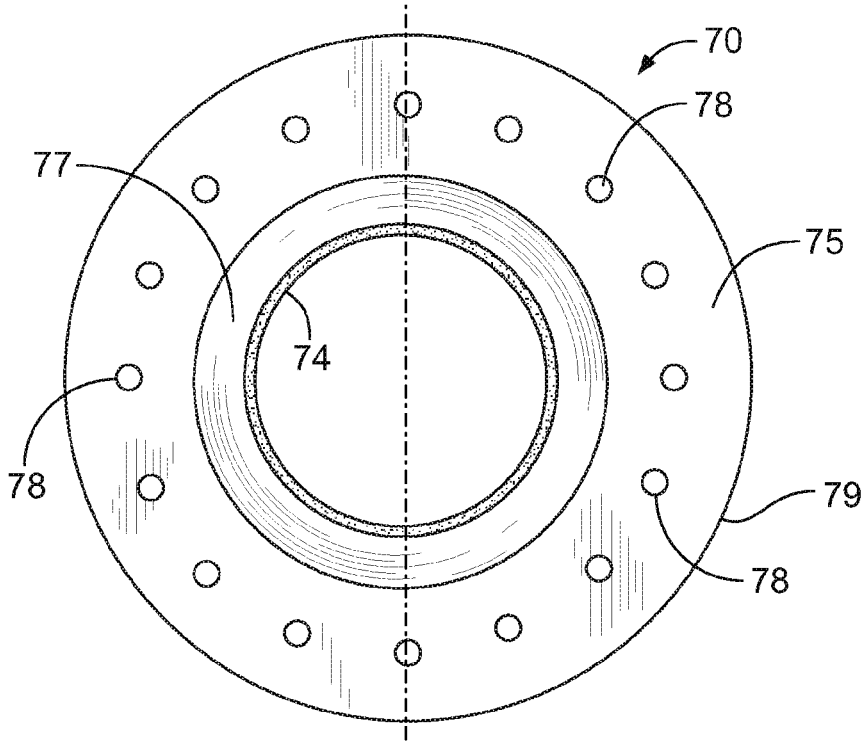
FIG. 5B is a top view of the flange and pipe shown in FIG. 5A.

Referring now to the flange embodiment illustrated in FIGS. 5*a* and 5B, there is shown the pipe 11 having the end 17 with the flange 70 attached thereto in a cross-sectional side view and in a top plan view, respectively. Shown most clearly in FIG. 5A, the flange 70 includes a divergent truncated inner conical surface 77 that is an exaggerated version of the beveled edge 69 of the flange 60 in FIG. 4. The surface 77 extends at a predetermined angle relative to the vertical, as indicated by the centerline CL, for reasons that will be described with reference to FIGS. 6 and 7 below. Surface 77 extends from the inner diameter edge of pipe end 17 to the surface 75. The inner diameter edge where surface 75 meets the pipe end 17 is also the location of the bead 74 that provides the weld connection between the two elements 75 and 11. A second weld bead 76 is provided at the outer edge of the pipe end 17, as shown.

Figure 6:
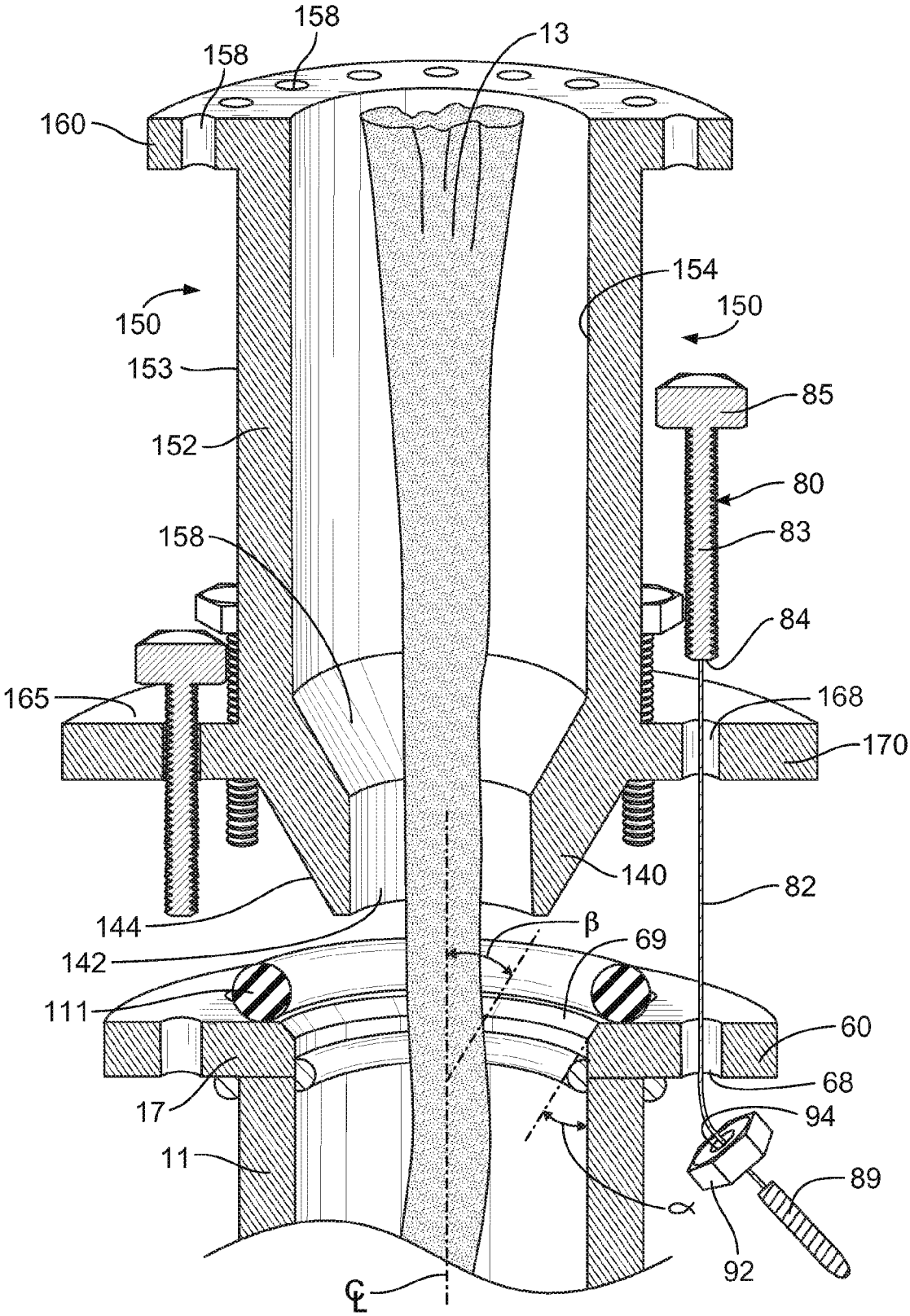
FIG. 6 is a schematic cross-sectional view of the engagement to seal a replacement pipe over the ruptured pipe in the process of being inserted into the flanged end of the wellhead pipe according to the present invention.

A plurality of throughholes 78 is arrayed, the throughholes 78 being spaced at predetermined distances from each other around the periphery of the flange surfaces and extending from the top surface 75 to the bottom surface 73. While 16 such throughholes 78 are shown, any number of throughholes 78 can be used commensurate with being able to hold securely the pipe connection described below in fluid tight condition by the bolts (FIG. 6). The number of bolts should be at least 4, and should be symmetrical around the periphery to enable the function of deploying the cover over the flanged end 17, 70 of pipe 11. For maintaining integrity of the flange 78, the radial distance of the throughholes 78, as measured from the centerline CL, should be about midway between the outer edge 79 of the flange 70 and the inner diameter edge where top surface 75 meets the truncated conical surface 77. Flanges 60, 70, 80 preferably comprise a high tensile strength metal, such as stainless steel, that may be treated so as to withstand the corrosive deep undersea environment and the high pressures and concentrated salts that are present therein.

Referring now to FIG. 6, in which the flanged end of the pipe 11 has been completely welded in accordance with the above descriptive embodiments, the flange 60 being illustrative only and described as an example, the cap structure that will be utilized to shut down the fluid flow from the end of the pipe 11 will be described. The exemplary flange 60 has been welded onto the end 17 of the pipe 11, and the capping structure, comprising a pipe containment fitting 150, is being used to cap the wellhead and to staunch the open flow fluid flow and eventually to shut down the well.

Figure 7:
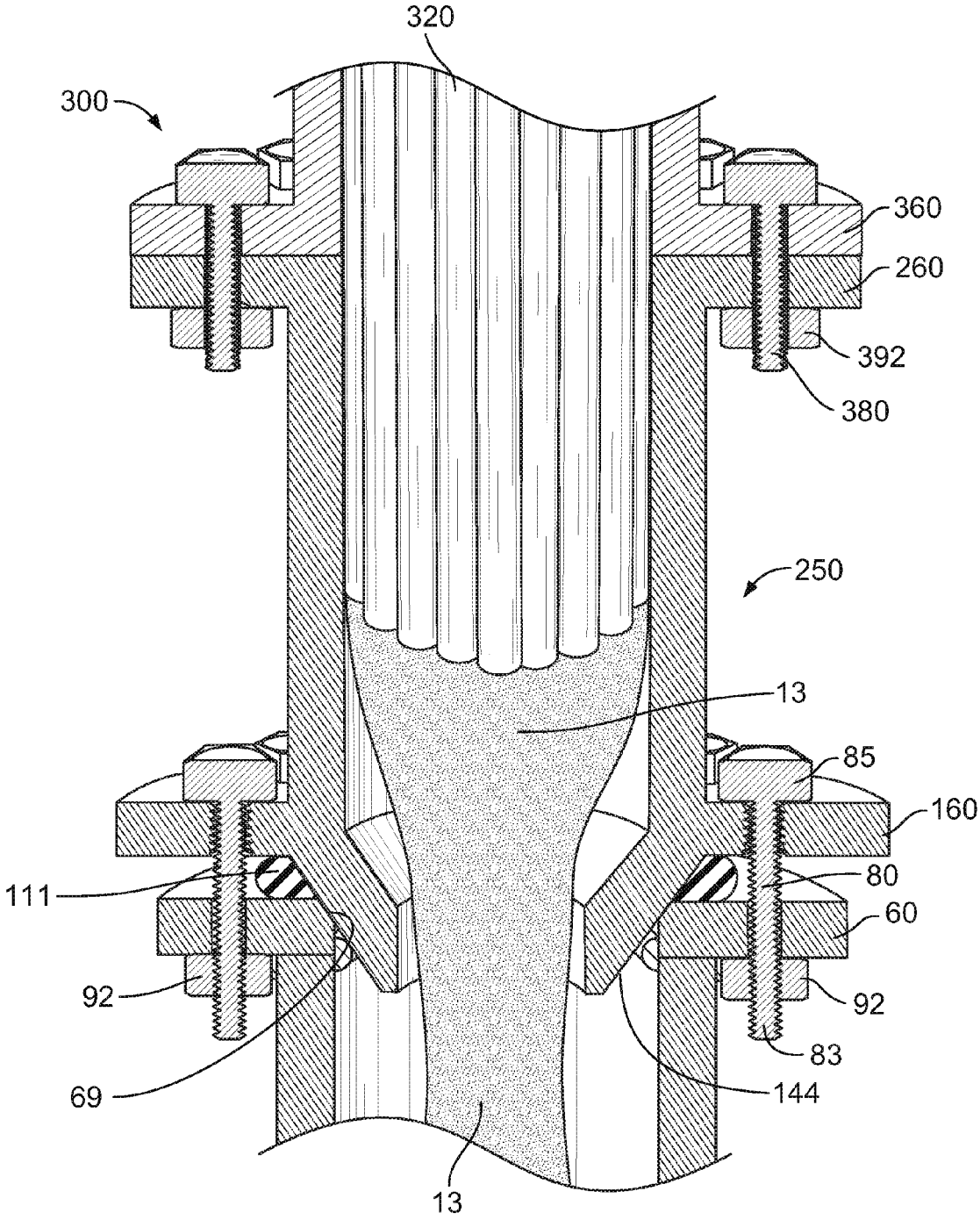
FIG. 7 is a is a schematic cross-sectional view of the engagement to seal an alternative replacement pipe according to the present invention bang disposed over the ruptured pipe and after it has been inserted into the flanged end of the wellhead pipe and sealed thereto.

The pipe containment fitting 150 is shown in two alternative embodiments in FIGS. 6 and 7 for illustration, but many modifications and alterations to the illustrated embodiments described herein will become apparent to the person having skill in the art. These and their equivalents are intended to be encompassed in this description, once the features and characteristics of the present invention are appreciated. For example, in FIG. 6 the embodiment of the pipe containment fitting 150 is shown having a cylindrical portion 152 for transporting hydrocarbon fluids and including a second flange 260 to which supporting equipment can be attached as shown in FIG. 7. However, one skilled in the art would be capable of altering this structure so that the cylindrical portion 152 and the flange 160 is a unitary structure and thereby providing benefit of reducing the number of steps necessary to complete the capping operation. However, to do this, other benefits of the illustrated design would have to be sacrificed, such as maneuverability of the equipment being attached to flange 260, etc.

Referring again to FIGS. 6 and 7, the undersea assembly of the capping structure 150 to the end 17 of the wellhead pipe 11 is shown at two successive stages. The first stage shown in FIG. 6 is after welding of the flange 60 on the end 17 of the pipe 11 has been completed (FIGS. 3-5B above) and the assembly of the pipe containment fitting 150 over the flange 60 is achieved. It should be appreciated that the containment fitting is usually attached, of repel at flange 260, to a fluid constrictor for stopping the fluid flow through the fitting and out of pipe 11, which equipment has not been shown in FIG. 6 for simplicity. Such equipment is known, and may comprise an assembly that can sequentially restrict the flow of fluid therethrough, and will ion most respects be massive, and can weight perhaps over several tons. An alternative means of restricting the fluid flow is shown attached to the embodiment of containment fitting 250 shown in FIG. 7, and will be described in greater detail below.

The pipe containment fitting 150 comprises the longitudinal cylindrical section 152 defined by the flange 160 at a top end and a by a truncated conical section 140 at a lower end. The flange 160 is similar to the flange 50 (FIG. 3) but is preferably integral with the cylindrical section 152, as shown in the cross-sectional view of FIG. 6. Flange 160 includes a series of equidistantly spaced throughholes 158 in the peripheral circumference of the flange 160 similar to the throughholes 58 (FIG. 4) for connecting the restrictor equipment (not shown). For purposes of this illustration, a stream of petroleum fluid 13 is shown flowing out of the pipe 11 and through the pipe containment fitting 150, although it should be realized that the stream 13 appears only as a small trickle compared to the flow of an actual undersea well that is open to the extreme pressures of the deep undersea petroleum production well. It has been estimated that an open undersea well may be spewing as much as 30,000 gallons per hour into the undersea environment.

Referring again to the pipe containment fitting 150 in FIG. 6, the cylindrical section 151 converges at its lower end to define a truncated conical section 140 having an aperture 132. The conical section 140 has an internal aperture that is about one-half to about ⅔ of the diameter of the inner diameter 154 of the cylindrical section 152. The portion 156 converging toward the aperture 132 forms the conical section 140, and provides a sloped inner diameter surface 158 that extends from the inner diameter 154 to the aperture 142. The outer surface 144 of the truncated conical section 140 also is sloped at an angle $\beta$, where preferably the two angles $\alpha$ (FIG. 4) and $\beta$, are essentially the same when these are measured relative to the axis CL of the cylindrical portion 152. Ideally, the angle $\alpha$ is the same angle as that of the slope $\beta$ of the surface 144 of truncated conical section 140 relative to the axis of the cylindrical section 152. In this way, and as shown in FIG. 7, the angled outer surface 144 of the truncated conical section 140 can engage the surface 69 so as to better seal the joint when the pipe containment fitting 150 is lowered onto the aperture in the flange (e.g. flange 60) defined by surface 62, as will be described.

Referring again to pipe containment fitting 150 of FIG. 6, approximately at the point where the angled or sloped surface 144 intersects with the outer surface 153 of cylindrical section 152, a second flange 170 is either welded onto the surfaces 144, 153 or the flange 170 is integral with the body of the pipe containment fitting 150, as shown. If welded, the welding can be performed at the surface as the fitting can then provide a unitary assembly that can be more easily manipulated at the under sea site. Flange 170 corresponds to and minors the configuration and orientation of the flange 60 so that the two flanges 60, 170 can engage and provide a fluid tight seal at the joint when the flanges are connected to each other, as shown in FIG. 7. Specifically, the flange 170 includes a number equidistantly disposed throughholes 168 that correspond with similar holes 68, and which are capable of receiving threaded bolts 80 that are inserted therethrough.

Threaded bolts 80 are specialty items that are provided with the pipe containment fitting 150, and provided for the specific purpose of guiding and bringing together the pipe containment fitting 150 and the flange 60. Bolts 80 include a long but very strong cable or wire 82 attached at one end to the underside 84 of bolt 80 spaced from the bolt head 86. The attachment may be welded or other appropriate attachment, but must be a very tensile strength such that it can withstand a great deal of tensile force in the longitudinal direction for the reasons described below. The other end of the cable wire 82 is attached a similar manner to a bobbin 89 for manipulating the bolt 80. The connections of the cable wire 82 to the underside 84 of bolt 80 and to bobbin 89 must be strong enough to withstand the tensile force of pulling the bolt and the combination of the pipe containment fitting 150 and all equipment in an undersea environment. The diameter of the preferably cylindrical shaped bobbin 89 is smaller than the diameter of the shaft of bolt 80 so that a hex nut 92 having a central threaded aperture 94 can accommodate the bobbin 89 to be inserted through the aperture 94, as will be described below.

Although a series of bolts 80 are shown poised for connecting the flange 170 to flange 60, only some of them will require the attached cable wire 82 and bobbin 89 as will be explained. However, each of them will require a nut 92 to secure the bolt 80 and thus to securely fasten the flanges 60, 170 to each other. While both sets of bolt throughholes 68, 168 are shown as being unthreaded, it is possible that at least one or both of the throughholes 68, 168 can be threaded and that bolts 80 can be connected to both the flanges to accommodate and to more securely hold the flanges 60, 170 in place. For example, the holes 68 in flange 60 may be threaded and the shafts 83 of bolts 80 may be inserted through unthreaded throughholes 168 and screwed into the threaded holes 168 (threads not shown in FIG. 6). Nuts 92 may be nevertheless attached to the bolts 80 to ensure that the flanges 60, 170 remain connected under all conditions, as shown in FIG. 7.

As shown in FIGS. 6 and 7, the fluid tight seal is completed by an elastic but incompressible O-ring 111 for completing a fluid tight seal between the flanges and the pipe 11, so as to stop any leak except that which would be flowing through the pipe 11 and equipment attached thereto. Preferably, this seal is comprised of a ring of nitrile rubber, but may also be comprised of any other suitable matter capable of performing the sealing function that is flexible to provide a static seal between the metal surface 144 and any of the metal surfaces 52, 62,69 and 75,77. Sealing need not be absolute, but the static seal provided by the sealing O-ring 111 should staunch the majority of the fluid flow 13 from the pipe 11 to the environment.

Referring now to FIG. 7, an alternative embodiment of the equipment, indicated generally by the identification numeral 300, which is attached to the contaminant fitting 250, is shown. The equipment includes a plurality of flexible hoses 320 that are arrayed in a pipe housing 280, having a flange 360, which is attached to a second flange 260 of the containment fitting 250. The containment fitting 250 is illustrated after the flanges 60, 160 have been joined by the bolts 80 and the bolts 80 have been tightened to compress the elastic and static seal provided by the preferably rubber O-ring 111, which seals the joint between the surfaces 69, 144. The nuts 92 have been completely tightened and the cable wires 82 (not shown in FIG. 7) are either removed or simply no longer relevant as having achieved their purposes of guiding the flanges 60, 160 to the required relative positions in which the bolts 80 can connect them, and thus simply are omitted from the drawing.

Figure 10:
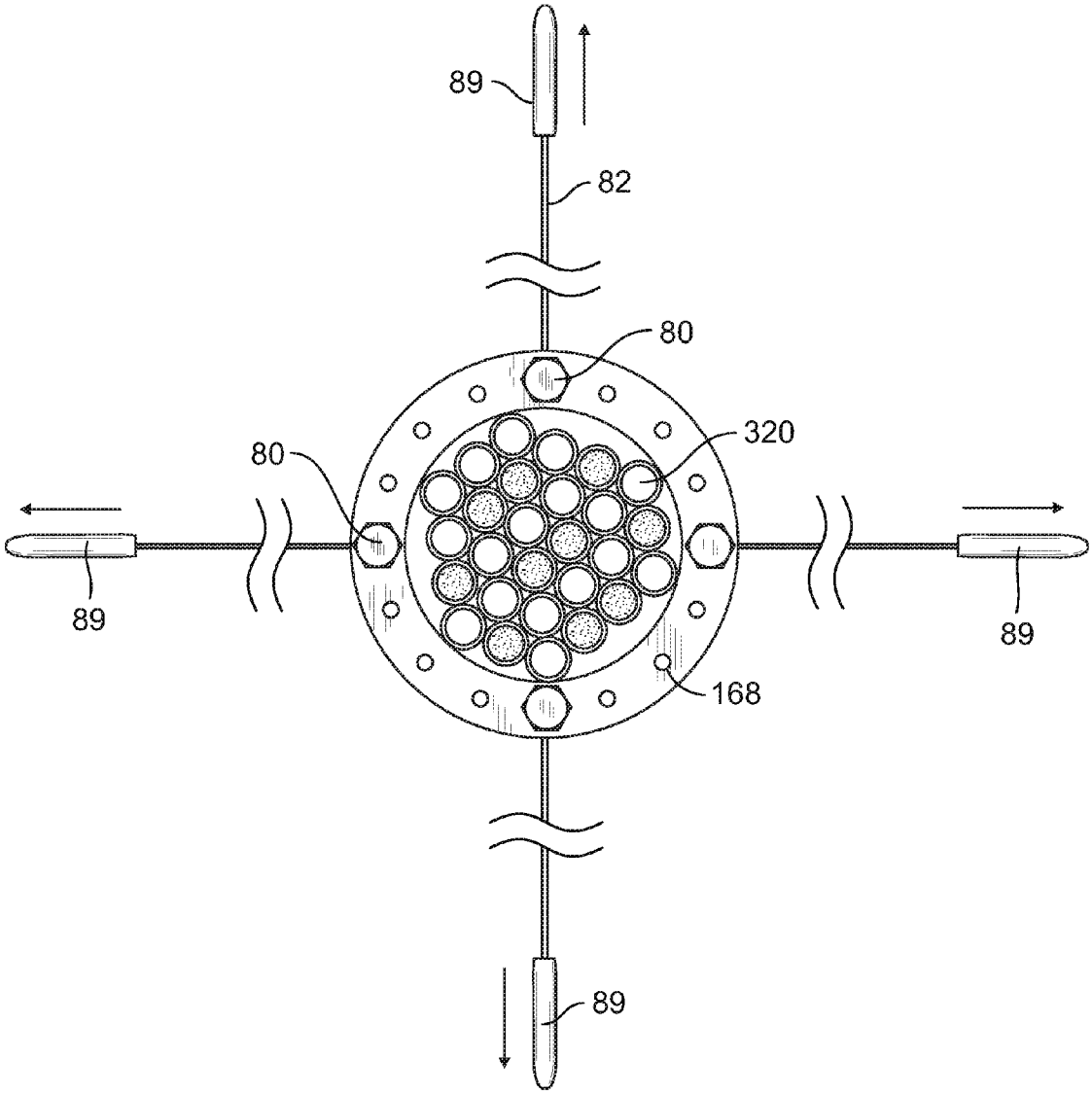
FIG. 10 is a schematic top plan view of the method of bringing together the two flanged members so that they can be joined.

It should be understood that bolts 80 are being illustrated in the method of bringing the containment fitting 150 so that the flanges 60, 160 can engage by pulling on the cable wires 182, as is shown in FIG. 10. Bolts 80 are only illustrative of the need to connect the flanges 60, 160 to each other, and they are also shown in FIG. 6 to provide for the engagement members bringing the flanges toward each other in the face of the gushing pressurized hydrocarbon fluid that is spewing forth from the end of the wellhead pipe 11. However, alternative methods of providing this function will come readily to mind to a person having ordinary skill in the art. For example, the use of bolts 80 may not be necessary, as a wire (not shown) can be used having an enlarged connection end, similar to the bolt end 85 (FIG. 6) which engages flange 160 at a top surface 165 thereof and pulls and guides the flange 160 toward flange 60 in a way to line up the throughholes, e.g., throughholes 68,168 for insertion of the bolts 80 in the throughholes in which the wires are not engaging the flange 160. The flange 160 is brought toward flange 68 by the action of the wires 82 being pulled outwardly and despite the force of the fluid spewing out of the pipe 11, the flanges 60, 160 can be brought together and connected to complete the seal.

Referring again to FIG. 7, the bolts are shown as having been completely engaged and the nuts 92 have been screwed onto the shafts 83. As the tightening of the bolts 80 proceeds, the elastic O-ring 11 is compressed and seals between the flange surfaces to provide a fluid tight seal therebetween, as shown, the fluid flow 13 then proceeds directly through the containment fitting 250 and into the flexible hoses 320. The flexible hoses 320 provide separate fluid flows of the hydrocarbon fluid through the equipment, for example, pipe 300, and at the surface 112, each flexible hose 320 can be individually shut down.

Figure 8:
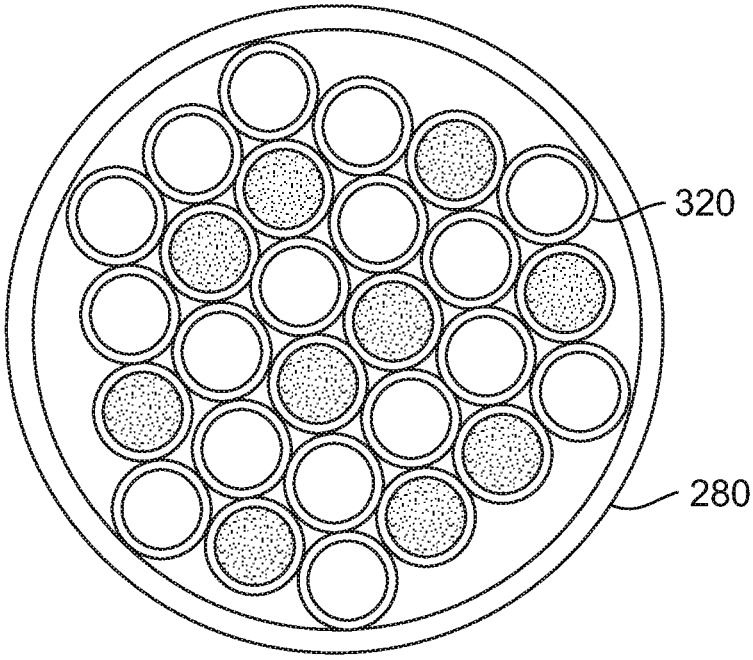
FIG. 8 is a cutaway top view of the replacement pipe of FIG. 7 in which a portion of the flexible hoses have been restricted from fluid flow and others continue to have the flow.

Referring now to FIG. 8, a cross-sectional view of the pipe 280, the flexible hoses 320 are arrayed in a pattern within the wall 280 of the pipe 300, and as shown, some flexible hoses 320 are shown as having fluid flowing through them and some in which the fluid flow has been shut off. Flexible hoses 320 are tubular in construction and permit the flow in the stream 13 of hydrocarbon fluids, even thick petroleum therethrough.

Figure 9:
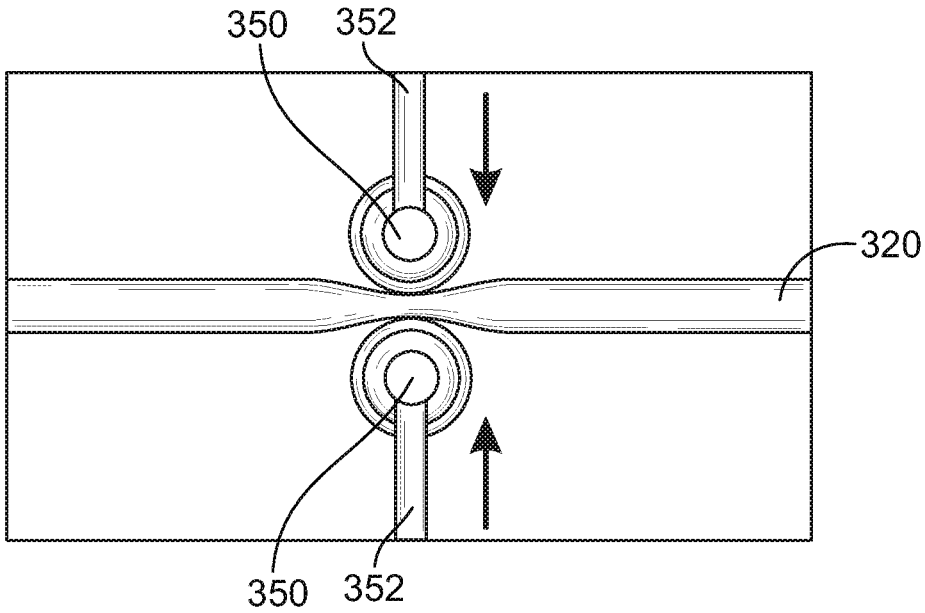
FIG. 9 is a detail view of the method of restricting the flexible tubes of the alternative replacement pipe shown in FIGS. 7 and 8 according to the present invention.

Referring now to FIG. 9, a method of shutting off the fluid flow in each pie 320 is shown in which two rods are brought together to squeeze each flexible hose 320 to cut off any fluid flow within the hoses 320. While the flow of hydrocarbon fluid continues through the flexible hoses as the flanges 60, 160 are connected and brought into engagement to provide a fluid tight seal, as the bolts 80 are completely tightened, the fluid flow in each flexible hose 320 can be shut off as shown by bringing two rods 350 toward each other with the hose 320 between them until fluid flow cease through that hose 320. The process is repeated with each hose 320 until all the fluid flow is stopped.

In the process for staunching the fluid flow of a runaway hydrocarbon fluid wellhead pipe 11, the first step is to provide a flange such as flanges 50, 60, 70, on the most protruding edge 17 of the pipe 11, and to use this as abase on which to add the equipment used for the constriction of the fluid flow in the pipe 11. To provide for a smooth surface 17 onto which a flange can be attached a remote-controlled submersible vehicle 130, such as are known, cut away any jagged edges of the pipe 11 and weld onto the surface 17 an appropriate flange as described above. Once that appropriate flange is attached and welded both on the inside and outside diameters, an appropriate flange engagement member 80 is provided, as shown in FIGS. 6 and 7, and one end having a bobbin 89 is passed through the appropriate ones of the throughholes 168 disposed in a flange 160 of a pipe containment fitting 150, one member 80 being shown in FIG. 6. The head 85 of the engagement member 80 is brought to and disposed adjacent the surface 165 of the pipe containment fitting 150. This is all done away from the spewing hydrocarbon fluid flow 13 of the wellhead pipe 11, and is performed by the remote-controlled submersible vehicle 130.

The cable wire 82 permits the bobbin 89 to be next passed through a second flange throughhole 68 of the flange 60 at the end of the pipe 11. A plurality of such engagement members 80 are disposed around the flange at equidistant and equal angled points, as is shown in FIG. 10. In the meantime, and away from the flow 13 of the wellhead pipe 11, the containment fitting 150 is raised above the hydrocarbon fluid flow 13 and the bobbins 89 are passed through a threaded nut 92 that is brought up to the underside 63 of the flange 60. Once all the bobbins 89 and cable wires 82 are passed through the appropriate holes, each of the plurality of bobbins 89 are pulled in opposed directions so that the downward force exerted on the flange 160 is evenly distributed around the periphery of the flange 160 as the cable wires 82 are being pulled at the same rate, thereby keeping the containment fitting 150 upright with the truncated conical portion 140 facing downwardly toward the fluid floe 13, as shown in FIG. 6.

The force of the fluid flow 13 acting on the flange 160 becomes stronger as the containment fitting 150 is brought closer to the flange 60. However, because of the truncated conical portion 140 of the containment fitting 150, having a central aperture 142, two things permit the joining of the flanges as shown in FIG. 7. First, fluid flows to pass through the aperture 142 and into the containment fitting 150 and then out into the undersea environment as the equipment at first does not constrict fluid flow. Secondly, the conical surface 144 directs any excess fluid flow to be outwardly directed so that the brunt of the fluid flow force does not impinge directly on the flange, but causes the fluid flow to be directed in a direction perpendicular to the axis CL. Thus, the force required to pull the containment fitting 150 over the flange 60 is decreased and is made possible without exerting a great deal of excessive tension on the cable wires 82.

Referring now to FIG. 10, preferably the four engagement members 80 shown are disposed at perpendicular angles relative to each other. Although four members 80 are shown, as few as three can be used and still retain the necessary stability. Alternatively, more than four can be used, as long as an even outwardly directed tensile force is provided equally at each member 80 to maintain the upright position of the containment fitting 150 and keep it upright. An appropriate spooling mechanism (not shown) takes up the wires 82 in an even and measured rate to lower the truncated conical portion 140 into the central aperture 62 of the flange 60 against the pressure of the fluid flow 13.

Again, the shape of the conical outer surface 144 lends itself to correct positioning of the containment fitting 150 despite the buffeting that it will be subject to as a result of the pressurized fluid flow that is spewing from the end of the pipe 11. While any angle $\alpha$ less than 90° would be appropriate as long as the truncated conical portion 140 deflects or permits the internal fluid flow 13, as described above. However, and as shown in FIGS. 4, 6 and 7 the angle $\alpha$ is significantly less than 90°, the angle $\alpha$ being about 45°, as is shown. A sloped surface of the flange can have other angles $\alpha$, as shown in the surface 77 of flange 70 in FIG. 5A. There, the angle $\alpha$ is about 15°, as is shown. Of course, for effective sealing between the flanges 70 and the containment fitting 150, the corresponding angle $\beta$ of the truncated conical section should have a similar angle to provide an appropriate engagement therebetween.

The invention herein has been described and illustrated with reference to the embodiments of FIGS. 3-10, but it should be understood that the features and operation of the invention as described is susceptible to modification or alteration without departing significantly from the spirit of the invention. For example, the dimensions, size and shape of the various elements may be altered to fit specific applications. Accordingly, the specific embodiments illustrated and described herein are for illustrative purposes only and the invention is not limited except by the following claims.

What is claimed is:

1. A containment fitting for capping a runaway deep undersea hydrocarbon well head comprising:

a) a longitudinally directed cylindrical portion having at least one peripheral wall defining an inner and an outer diameter, and top and bottom ends;

b) a truncated conical portion having a shape disposed adjacent the bottom end of the longitudinally directed cylindrical portion, the truncated conical portion having a convergent outer surface extending from an intersection of the at least one peripheral wall and the convergent outer surface, and converging toward a central aperture having an inner diameter at least one-half of the inner diameter of the longitudinally directed cylindrical portion; and c) a flange extending outwardly from the intersection of the at least one peripheral wall and the convergent outer surface and extending essentially perpendicularly from the outer surface of the at least one peripheral wall and being disposed completely around the at least one peripheral wall, wherein the flange further comprises a plurality of throughholes extending therethrough around a circumference of the flange;

d) plural engagement members each comprising an enlarged head at one end and a wire extending in a direction away from the enlarged head, the wires having a bobbin;

e) wherein the runaway deep undersea hydrocarbon well head has a second flange having a plurality of throughholes disposed around a circumference of the second flange; and f) wherein the plural engagement members are pulled to align the plurality of thoughholes of the flange and the plurality of throughholes of the second flange for attaching the flange to the second flange of the runaway deep undersea hydrocarbon well head.

2. The containment fitting according to claim 1 further comprising a conical angle $\alpha$ relative to a centerline that provides for the shape of the truncated conical portion, that angle α being in a range of between 10° and 60° .

3. The containment fitting according to claim 2 further comprising a conical angle α relative to a centerline that provides for the shape of the truncated conical portion, that angle α being in a range of between 30° and 50° .

4. The containment fitting according to claim 3 further comprising a conical angle α relative to a centerline that provides for the shape of the truncated conical portion, that angle α being approximately 45° .

5. The containment fitting according to claim 1 wherein the flange further comprises a welded connection to the longitudinally directed cylindrical portion.

6. The containment fitting according to claim 1 wherein the second flange is welded to the deep undersea hydrocarbon well head at an upper portion thereof.

7. A method for capping a wellhead pipe of a runaway deep undersea hydrocarbon well, comprising:

a) locating a pipe flange disposed on and sealingly connected to an end of the wellhead pipe of the runaway deep undersea hydrocarbon well, the pipe flange having plural throughholes of a predetermined diameter extending through a width of the pipe flange and disposed around a circumference of the pipe flange;

b) providing a containment fitting having a longitudinally directed cylindrical portion and a truncated conical portion defining a central aperture at the truncated part, and a fitting flange extending outwardly essentially perpendicularly from the surface of the longitudinally directed cylindrical portion, the fitting flange having plural throughholes of a predetermined diameter extending through a width of the fitting flange and disposed around a circumference of the fitting flange, the fitting flange throughholes accommodating in size, orientation and number to at least a majority of the plural throughholes of the pipe flange;

c) providing plural flange engagement members each comprising an enlarged head at one end having a diameter larger than the predetermined diameter and a wire extending in a direction away from the enlarged head, the wires each having a bobbin at an end removed from the enlarged head;

d) threading the bobbin of each flange engagement member through selected ones of the plural throughholes of the fitting flange so as to engage an upper surface of the fitting flange;

e) threading the bobbin of each engagement member through selected ones of the plural throughholes of the pipe flange corresponding to the selected throughholes of the fitting flange; and f) pulling the wires and bobbins in a direction perpendicularly outward from the pipe and fitting flanges so as to pull the enlarged heads of the flange engagement members and the fitting flange toward the pipe flange; and g) inserting bolts through both the fitting flange and pipe flange throughholes and engaging the bolts and nuts to retain the pipe and fitting flanges in an engaged condition.

8. The method of claim 7 further comprising disposing an O-ring between the opposing surfaces of the pipe and fitting flanges to seal therebetween when the bolts are engaged by the nuts.

9. A system for capping a runaway deep undersea hydrocarbon wellhead comprising:

a) a cutter for cutting a ruptured end of the runaway deep undersea wellhead through which fluid hydrocarbons are escaping to provide an attachment end portion disposed adjacent a longitudinally directed pipe cylindrical portion of the wellhead;

b) a pipe flange for attaching to the attachment end portion by underwater welding the pipe flange to the attachment end portion, the pipe flange having a plurality of pipe flange throughholes extending therethrough in a direction generally parallel to the longitudinal direction of the longitudinally directed pipe cylindrical portion of the wellhead;

c) a containment fitting for attachment to the pipe flange, comprising:

a longitudinally directed fitting cylindrical portion having at least one peripheral wall extending in a fitting longitudinal direction and defining an inner diameter and an outer diameter at an outer surface, and top and bottom ends;

a truncated conical portion disposed adjacent the bottom end of the longitudinally directed fitting cylindrical portion, the truncated conical portion having a convergent outer surface extending from an intersection of the at least one peripheral wall and the convergent outer surface of the truncated conical portion, and converging toward a central aperture having an inner diameter at least one-half of the inner diameter of the longitudinally directed fitting cylindrical portion; and a fitting flange extending outwardly from the intersection of the at least one peripheral wall and the convergent outer surface and extending essentially perpendicularly to the fitting longitudinal direction from the outer surface of the at least one peripheral wall and being disposed completely around the at least one peripheral wall, the fitting flange having a plurality of fitting flange throughholes extending therethrough in a direction generally parallel to the fitting longitudinal direction of the fitting cylindrical portion;

d) a plurality of bobbins attached to wires for insertion through both the fitting flange throughholes and then through the pipe flange throughholes, the each of the bobbins being attached by one of said wires to a threaded bolt at an end of the one of said wires removed from the bobbin;

e) a drawing mechanism for drawing the bobbins in a direction away from the pipe flange throughholes such that the threaded bolt engages the fitting flange throughholes and continued drawing of the plurality of bobbins enables each of the threaded bolts to be inserted into the plurality of pipe flange throughholes; and f) plural nuts through which the plurality of bobbins have been inserted that are shaped, oriented and positioned to engage the threaded bolts and attach the fitting flange to the pipe flange.

10. The system according to claim 9 further comprising an incompressible O-ring for disposition between opposing surfaces of the pipe and fitting flanges to provide a fluid tight seal therebetween when the threaded bolts are engaged by the plural nuts.

* * * * *